US008359823B2

(12) United States Patent
Qi

(10) Patent No.: US 8,359,823 B2
(45) Date of Patent: Jan. 29, 2013

(54) STEEL CORD FOR REINFORCING TIRE

(75) Inventor: Lixun Qi, Weihai (CN)

(73) Assignee: NV Bekaert SA, Zwevegem (BE)

( * ) Notice: Subject to any disclaimer, the term of this patent is extended or adjusted under 35 U.S.C. 154(b) by 26 days.

(21) Appl. No.: 13/143,268

(22) PCT Filed: Dec. 9, 2009

(86) PCT No.: PCT/EP2009/066670

§ 371 (c)(1),
(2), (4) Date: Jul. 5, 2011

(87) PCT Pub. No.: WO2010/079034

PCT Pub. Date: Jul. 15, 2010

(65) Prior Publication Data

US 2011/0268954 A1 Nov. 3, 2011

(30) Foreign Application Priority Data

Jan. 9, 2009 (EP) ..... 09150269

(51) Int. Cl.
*D02G 3/48* (2006.01)

(52) U.S. Cl. ..... 57/212; 57/311

(58) Field of Classification Search ..... 57/212, 57/311; 152/451, 527, 556
See application file for complete search history.

(56) References Cited

U.S. PATENT DOCUMENTS

| | | | | |
|---|---|---|---|---|
| 5,321,941 | A * | 6/1994 | Bollen et al. | 57/213 |
| 5,606,852 | A * | 3/1997 | Yanagisawa | 57/207 |
| 5,802,830 | A * | 9/1998 | Kawatani | 57/212 |
| 5,878,564 | A * | 3/1999 | De Vos et al. | 57/311 |
| 5,911,675 | A * | 6/1999 | Obana | 57/212 |
| 6,016,647 | A * | 1/2000 | Kawatani et al. | 57/9 |
| 6,109,017 | A | 8/2000 | Kawatani | |
| 6,405,774 | B1 * | 6/2002 | Komatsu | 152/556 |
| 6,695,026 | B2 * | 2/2004 | Miyazaki et al. | 152/527 |
| 6,745,806 | B2 * | 6/2004 | Miyazaki et al. | 152/556 |
| 6,829,880 | B2 * | 12/2004 | Noferi | 57/9 |
| 7,131,257 | B2 * | 11/2006 | Miyazaki et al. | 57/236 |

FOREIGN PATENT DOCUMENTS

| | | | |
|---|---|---|---|
| EP | 0 301 776 | B1 | 10/1992 |
| JP | 4-308287 | A | 10/1992 |
| JP | 6-108387 | A | 4/1994 |
| JP | 10-298880 | A | 11/1998 |
| JP | 11-36182 | A | 2/1999 |
| JP | 2000-80578 | A | 3/2000 |
| JP | 2005-23494 | A | 1/2005 |
| JP | 2006-225801 | A | 8/2006 |
| WO | WO 95/16816 | A1 | 6/1995 |
| WO | WO 02/088459 | A1 | 11/2002 |

OTHER PUBLICATIONS

"Polygonally Preformed Steel Elements", *Research Disclosure,* Mason Publications, No. 323, Jul. 1, 1994, pp. 359-365.

* cited by examiner

*Primary Examiner* — Shaun R Hurley
(74) *Attorney, Agent, or Firm* — Foley & Lardner LLP

(57) ABSTRACT

A steel cord (50) comprises a core layer and an outer layer. The core layer comprises a number of first steel filaments (10) and the outer layer comprises a number of second steel filaments (20). The outer layer is helically twisted around the core layer. The first steel filaments have a twisting pitch greater than 310 mm. At least one of the first steel filaments (10) is wavy preformed in one plane. At least one of the second steel filaments (20) is polygonally preformed.

14 Claims, 2 Drawing Sheets

STEEL CORD FOR REINFORCING TIRE

FIELD OF THE INVENTION

The present invention relates to a steel cord comprising a core layer with one or more preformed filaments and an outer layer. The steel cord can be adapted for reinforcement such as a belt or breaker structure of tire.

BACKGROUND OF THE INVENTION

Steel cord comprising preformed filaments are known in the art. The 4+6 structure of the steel cord is also disclosed.

EP0301776A1 provides a cord structure of 4+6. It discloses a low profile radial tire reinforced with steel cords composed of two layers of a core and an outer layer, the core comprising 3 or 4 filaments and the outer layer comprising a number of filaments equal to or less than the number of the core filaments, the filaments being substantially equal in diameter, the core filaments and the outer filaments having a twist of the same hand but a different pitch, the aspect ratio of the tire being at most 0.85. The patent document also discloses the cord structure can be 4+6. However the steel cord according to the patent document has no full rubber penetration. As a consequence humidity may reach the individual steel filaments during use, which may drastically decrease the life time of the steel cord and of the reinforced tire.

Full rubber penetration means that rubber must be able to penetrate into the cord between the composing elements and fill all possible interstices in order to reduce fretting and tensions between the elements and to avoid moisture from traveling along the cord, which would cause a lot of corrosion and which would considerably reduce the life of the cord and the rubber product.

WO02/088459A1 provides a steel cord comprising a first group and a second group. The first group comprises 4 filaments and the second group comprises 6 filaments. The first group is helically twisted around the second group. The first filaments have a twisting step greater than 300 mm. The second filaments are polygonally preformed. The first steel filaments have a spatial wave form. It discloses the spatial wave is not a planar wave, and it has a first crimp and a second crimp. The first crimp lies in a plane which is substantially different from the plane of the second crimp. Due to process of spatial wave, e.g. two subsequent crimps in different planes, high tensions are introduced in the first filaments and the residual stress of the first filaments is very high. It causes high sequential breaking rate of the cord. According to this the breaking load of the cord can not up to requirement. Also due to the process of spatial wave, the wear of the crimp device is high.

SUMMARY OF THE INVENTION

It is an object of the present invention to overcome the problem of the prior art.

It is a further object of the present invention to provide a steel cord with full rubber penetration and high breaking load.

It is yet another object of the present invention to provide a steel cord which can be made in an economical way.

According to the present invention, a steel cord comprises a core layer and an outer layer. The core layer comprises a first number of first steel filaments. The first number ranges from 3 to 8. And first steel filaments have a twist pitch greater than 310 mm. The outer layer comprises a second number of second steel filaments. The second number ranges from 3 to 10. At least one of the second steel filaments is polygonally preformed. The outer layer is helically twisted around the core layer with a core twist pitch, and the core twist pitch ranges from 15 $R_f$ to 150 $R_f$ when the average diameter of the second steel filaments is $R_f$ mm. At least one of said first steel filaments is preformed into wavy form in one plane. The wave height ranges from 1.2 $D_f$ mm to 2.4 $D_f$ mm when the average diameter of the first steel filaments is $D_f$ mm, and the wave length ranges from 10 $D_f$ mm to 25 $D_f$ mm.

The technique of polygonal preforming is disclosed in WO95/16816.

Polygonal preforming is different from spiral preforming. Although both of them are three dimensionally preforming or spatial preforming, to the persons skilled in the art, polygonal preforming and spiral preforming are different types of preforming.

Polygonal preforming is a preforming which gives the steel filament projections on a plane perpendicular to the longitudinal central axis. The projections are in the form of curves which are convex curves with a radius of curvature alternating between a maximum and a minimum. The radius of the curvature of the preformed steel filament alternates between two extremes: a minimum at the point where the highest bending has been given and a maximum at the point where the smallest bending has been given. As a consequence of the rotating of the filament around its own longitudinal axis, the radius of curvature of the steel filament always points in the direction of a central axis of the steel wire. It means that the polygon has a convex form. In other words, the zone of plastical tension of the steel filament always lies radially inward while the zone of plastical compression lies radially outward.

JP 06108387 describes a steel cord with a two dimensional preforming on core wires and a spirally preforming on outer wires. In the art spiral preforming without special description means that a preforming in the form of curves which are circular curves with a radius of the curvature is a fixed value or a continuous monotonic function. It means that the curves of spiral preformed steel filament are rather circular curves.

Preferably the wave height ranges from 1.6 $D_f$ mm to 2.0 $D_f$ mm. Most preferably the wave height ranges from 1.7 $D_f$ mm to 1.9 $D_f$ mm.

Preferably the wave length ranges from 12 $D_f$ mm to 20 $D_f$ mm. Most preferably the wave length ranges from 14 $D_f$ mm to 16 $D_f$ mm.

According to the present invention $D_f$ is the average diameters of the first steel filament. $D_f$ ranges from 0.06 mm to 1.0 mm. Preferably $D_f$ ranges from 0.2 mm to 0.5 mm. Most preferably $D_f$ ranges from 0.3 mm to 0.4 mm. The $D_f$ may be 0.35 mm or 0.38 mm.

According to the present invention the core twist pitch ranges from 15 $R_f$ to 150 $R_f$. Preferably the core twist pitch ranges from 40 $R_f$ to 70 $R_f$.

The outer layer can be twisted around each other with an outer twist pitch. The outer twist pitch ranges from 15 $R_f$ to 150 $R_f$. Preferably the outer twist pitch ranges from 40 $R_f$ to 70 $R_f$. Most preferably the outer twist pitch is equal to the core twist pitch.

According to the present invention $R_f$ is the average diameter of the second steel filaments. $R_f$ ranges from 0.06 mm to 1.0 mm. Preferably $R_f$ ranges from 0.2 mm to 0.5 mm. Most preferably $R_f$ ranges from 0.3 mm to 0.4 mm. The $R_f$ can be 0.35 mm or 0.38 mm.

According to the present invention, $R_f$ can be different from $D_f$ or not. Preferably $R_f$ is equal to $D_f$.

Preferably the first number ranges from 3 to 5. Most preferably the first number is 4.

Preferably the second number ranges from 5 to 8. Most preferably the second number is 6.

The second number can be equal to the first number. Preferably the second number is greater than the first number.

The structure of the steel cord can be 3+3, 3+4, 3+5, 3+6, 3+7, 3+8, 3+9, 3+10, 4+4, 4+5, 4+6, 4+7, 4+8, 4+9, 4+10, 5+5, 5+6, 5+7, 5+8, 5+9, 5+10, 6+6, 6+7, 6+8, 6+9, 6+10, 7+7, 7+8, 7+9, 7+10, 8+8, 8+9, or 8+10.

According to the present invention at least one of the first steel filaments is wavy preformed in one single plane. Preferably all the first steel filaments are wavy preformed in one single plane. No other performing is imposed on the first filaments.

As the steel filament is preformed into wavy form in one plane, compared with the spatial wave form, the steel filament has lower strength loss. The sequential breaking rate of the steel cord comprising such preformed steel filament is much lower. The breaking load of the steel cord is same as the prior steel cord or even higher. Also the wear of the crimp device is lower.

According to the present invention at least one of the second steel filaments is polygonally preformed. Preferably all the second steel filaments are polygonally preformed.

The polygonal preforming of the second steel filaments gives an open structure to the steel cord which allows rubber or other matrix material to penetrate until the first steel filaments.

According to the present invention the first steel filaments have a twist pitch greater than 310 mm. Preferably the first steel filaments are untwisted.

The sequential breaking rate of the steel cord is less than 20%, and even less than 10%. The breaking load is more than 2965N while the steel cord has full rubber penetration.

According to the present invention, the steel cord can be used as reinforcement such as the belt layer or breaker structure to reinforce tires intended for industrial vehicles selected from subway trains, buses, road transport machinery, off load machinery, aircraft and other transport or handling vehicles.

BRIEF DESCRIPTION OF THE DRAWINGS

The invention will now be described into more detail with reference to the accompanying drawings wherein.

DESCRIPTION OF THE PREFERRED EMBODIMENTS OF THE INVENTION

Figure 1:
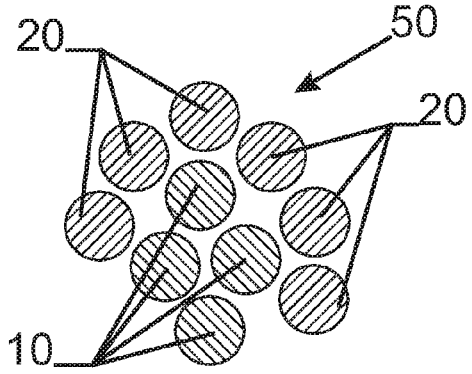
FIG. 1 shows a cross-section of a steel cord with a structure of 4+6

A first preferred embodiment is shown in FIG. 1. The steel cord 50 has the core layer comprising four first steel filaments 10 and the outer layer comprising six second steel filaments 20. The outer layer is helically twisted around the core layer with a core twist pitch of 23 mm, and the diameter of the steel filament 20 is 0.38 mm.

Figure 2:
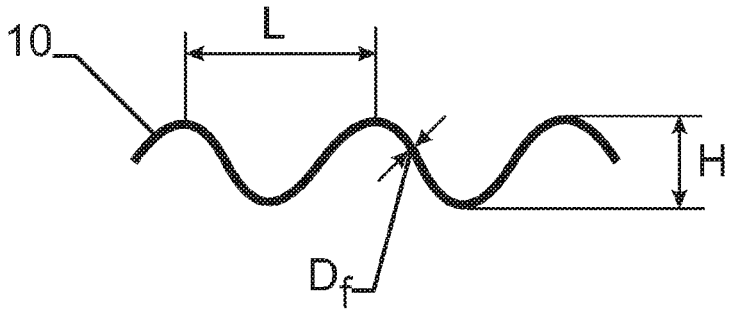
FIG. 2 shows a side view of the preformed first steel filament
Figure 3:
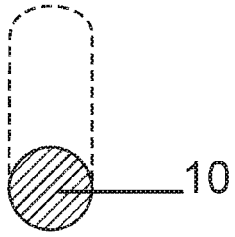
FIG. 3 shows a front view of the preformed first steel filament

The four first steel filaments 10 are wavy preformed in one single plane and untwisted, i.e. they are parallel to each other. FIG. 2 and FIG. 3 illustrate respectively a side view and a front view of the first second steel filament 10. The wave height H is 0.65 mm and the wave length L is 5.13 mm while the diameter $D_f$ is 0.38 mm.

Figure 4:
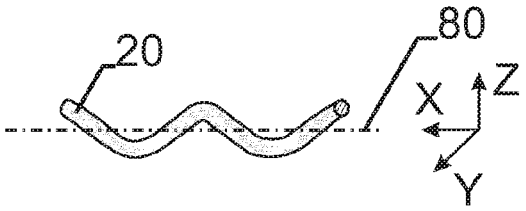
FIG. 4 shows a side view of the preformed second steel filament
Figure 5:
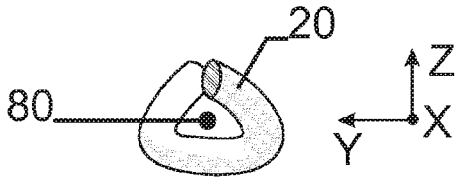
FIG. 5 shows a front view of the preformed second steel filament

The six second steel filaments 20 are polygonally preformed and twisted around each other with the outer twist pitch of 23 mm. FIG. 4 and FIG. 5 illustrate respectively a side view and a front view of the second steel filament 20. The X-axis is parallel to the longitudinal and central axis 80, while the Y-axis and the Z-axis lie in a plane perpendicularly to the central axis 80. From FIG. 5, the polygonal preforming takes in the form of curves with rounded edges rather than the usual circular form, and the scales in Y- and Z-direction are much larger than the scale in X-direction.

The process for manufacturing the embodiment comprises follow steps:

(i) the four first steel filaments 10 are guided towards a pair of toothed wheels which give the filaments a crimp preforming in one plane;

(ii) the bundle of first steel filaments is guided towards the first flyer of a double twisting apparatus where the bundle of first steel filaments is receiving two twists in a first twisting direction, e.g. in Z-direction;

(iii) inside the rotating flyers of the double-twisting apparatus, the six second steel filaments 20 are guided towards a preforming device which gives the second steel filaments a polygonal preforming;

(iv) than the bundles of first steel filaments and second steel filaments are guided towards the second flyer of the double twisting apparatus together, where they are receiving another two twists, however now in a second opposite twisting direction, e.g. in S-direction; therefore the core layer comprising the first steel filaments is untwisted—the twists in Z-direction are compensated by the twists in S-direction—and the outer layer comprising the second steel filaments is twisted, e.g. in S-direction.

Figure 6:
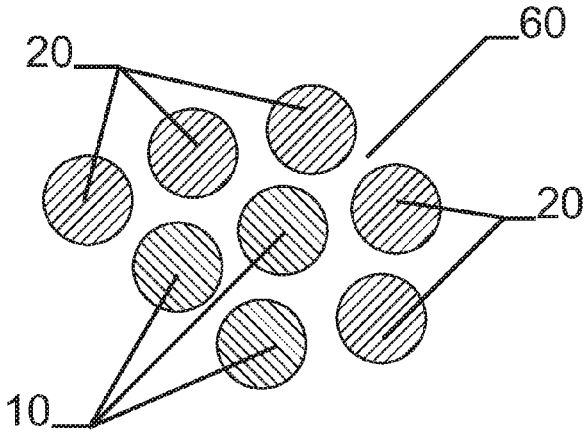
FIG. 6 shows a cross-section of a steel cord with a structure of 3+5

A second preferred embodiment is shown in FIG. 6. The steel cord 60 has the core layer comprising three first steel filaments 10 and the outer layer comprising five second steel filaments 20. The diameter of the steel filament 10 is 0.35 mm. The diameter of the steel filament 20 is 0.35 mm. The three first steel filaments 10 are wavy preformed and untwisted. The wave height is 0.60 mm and the wave length is 5.52 mm. The five second steel filaments 20 are polygonally preformed and twisted around each other with the outer twist pitch of 20 mm. The outer layer is helically twisted around the core layer with the core twist pitch of 20 mm.

Figure 7:
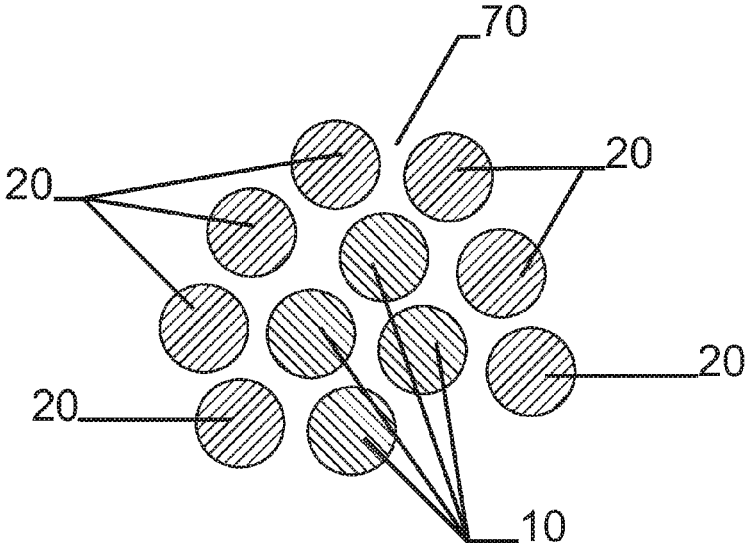
FIG. 7 shows a cross-section of a steel cord with a structure of 4+7

A third preferred embodiment is shown in FIG. 7. The steel cord 70 has the core layer comprising four first steel filaments 10 and the outer layer comprising seven second steel filaments 20. The diameter of the steel filament 10 is 0.35 mm. The diameter of the steel filament 20 is 0.38 mm. The four first steel filaments 10 are wavy preformed and untwisted. The wave height is 0.56 mm and the wave length is 6.08 mm. The seven second steel filaments 20 are polygonally preformed and twisted around each other with the outer twist pitch of 18 mm. The outer layer is helically twisted around the core layer with the core twist pitch of 19 mm.

Compared with the steel cord S with the structure of 4+6 mentioned in the WO02/088459A1, some properties of the present invention are measured. The table 1 hereunder summarizes the result.

TABLE 1

| Property | Invention First preferred embodiment | Invention Second preferred embodiment | Invention Third Preferred embodiment | Prior Art Steel cord S |
|---|---|---|---|---|
| Sequential breaking rate (%) | 0.6% | 6.5% | 5.8% | 62.3% |
| Breaking load (N) | 2965 | 2970 | 2972 | 2940 |
| Rubber penetration (%) | 100% | 100% | 100% | 100% |

The steel filament adapted for the steel cord comprises a carbon content more than 0.70%, preferably more than 0.80%, or more than 90%. It can also contain: manganese (content ranging from 0.20% to 1.00%), sulphur and phosphorus (contents being limited to 0.05%), and/or silicon (content ranging from 0.10% to 0.90%). Additionally chromium, nickel, boron, nickel, vanadium, molybdenum, niobium, copper, calcium, aluminum, titanium and/or nitrogen may be added.

The steel filament is preferably coated with a metallic coating. The coating may be a corrosion resistant coating that promotes the adhesion to the matrix material such as zinc-copper alloy (either low copper −63.5% Cu or high copper −67.5% Cu), or a ternary brass such as zinc-copper-nickel or zinc-copper-cobalt.

The tensile strength of the steel filament may dependent upon the steel filament composition, the degree of the preforming and the diameter of the filament. Preferably the steel filament has a high tensile strength. Most preferably the steel filament has a tensile strength up to 4000 MPa.

The diameter of one steel filament may be different from the others inside the core layer of first steel filaments and/or the diameter of one steel filament may be different from the others inside the layer of second steel filaments.

The invention claimed is:

1. A steel cord comprises a core layer and an outer layer;

said core layer comprising a first number of first steel filaments, said first number ranging from 3 to 8, said first steel filaments having a twist pitch greater than 310 mm;

said outer layer comprising a second number of second steel filaments, said second number ranging from 3 to 10, at least one of said second steel filaments being polygonally preformed;

said outer layer is helically twisted around the core layer with a core twist pitch, and the core twist pitch ranging from 15 $R_f$ to 150 $R_f$ when the average diameter of the second steel filaments is $R_f$mm;

characterized in that at least one of said first steel filaments is preformed into wavy form in one single plane, and the wave height ranges from 1.2 $D_f$ mm to 2.4 $D_f$ mm when the average diameter of the first steel filaments is $D_f$mm, and the wave length ranges from 10 $D_f$mm to 25 $D_f$mm.

2. A steel cord as claimed in claim 1, characterized in that the wave height ranges from 1.6 $D_f$ mm to 2.0 $D_f$ mm.

3. A steel cord as claimed in claim 2, characterized in that the wave height ranges from 1.7 $D_f$ mm to 1.9 $D_f$ mm.

4. A steel cord as claimed in claim 1, characterized in that the wave length ranges from 12 $D_f$ mm to 20 $D_f$ mm.

5. A steel cord as claimed in claim 4, characterized in that the wave length ranges from 14 $D_f$ mm to 16 $D_f$ mm.

6. A steel cord as claimed in claim 1, characterized in that the second number of second steel filaments of the outer layer are twisted around each other with an outer twist pitch.

7. A steel cord as claimed in claim 6, characterized in that said outer twist pitch is equal to said core twist pitch.

8. A steel cord as claimed in claim 1, characterized in that the first number ranges from 3 to 5 and the second number ranges from 5 to 8.

9. A steel cord as claimed in claim 8, characterized in that the first number is 4 and the second number is 6.

10. A steel cord as claimed in claim 1, characterized in that all the second steel filaments are polygonally preformed.

11. A steel cord as claimed in claim 1, characterized in that all the first steel filaments are wavy preformed.

12. A steel cord as claimed in claim 1, characterized in that at least one of said first filaments has no other preforming except for said wavy preforming in one single plane.

13. A composite product characterized in that said product is reinforced by a steel cord as claimed in claim 1.

14. A composite product as claimed in claim 13, characterized in that said product is a tire.

* * * * *